US008929770B2

(12) United States Patent
Sato

(10) Patent No.: US 8,929,770 B2
(45) Date of Patent: Jan. 6, 2015

(54) IMAGE FORMING APPARATUS INCLUDING ENDLESS BELT DISPOSED ABOVE PHOTOSENSITIVE DRUM

(71) Applicant: Brother Kogyo Kabushiki Kaisha, Nagoya (JP)

(72) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/319,962

(22) Filed: Jun. 30, 2014

(65) Prior Publication Data

US 2014/0314446 A1 Oct. 23, 2014

Related U.S. Application Data

(63) Continuation of application No. 13/432,473, filed on Mar. 28, 2012, now Pat. No. 8,768,206.

(30) Foreign Application Priority Data

Jun. 27, 2011 (JP) ..... 2011-141602

(51) Int. Cl.
*G03G 15/01* (2006.01)
*G03G 21/16* (2006.01)

(52) U.S. Cl.
CPC ..... *G03G 21/1619* (2013.01)
USPC ..... 399/110; 399/112; 399/125

(58) Field of Classification Search
USPC ..... 399/110, 111, 112, 125
See application file for complete search history.

(56) References Cited

U.S. PATENT DOCUMENTS

| | | | |
|---|---|---|---|
| 7,664,428 | B2 | 2/2010 | Kei |
| 2009/0092412 | A1 | 4/2009 | Kei |
| 2009/0142092 | A1 | 6/2009 | Sato |
| 2011/0293324 | A1 | 12/2011 | Hoashi |
| 2011/0311269 | A1 | 12/2011 | Murooka |
| 2012/0183321 | A1 | 7/2012 | Mori et al. |
| 2012/0328326 | A1 | 12/2012 | Sato |
| 2012/0328327 | A1 | 12/2012 | Sato |

FOREIGN PATENT DOCUMENTS

| | | |
|---|---|---|
| JP | 2009-092914 | 4/2009 |
| JP | 2010244071 A | 10/2010 |

*Primary Examiner* — Sophia S Chen
(74) *Attorney, Agent, or Firm* — Banner & Witcoff, Ltd.

(57) ABSTRACT

An image forming apparatus includes a frame, a photosensitive drum, an endless belt disposed above the photosensitive drum, and a pressing member. The photosensitive drum includes a drum body and a flange portion that is provided on one end portion of the drum body. The flange portion has a contacted portion and a pressed portion. The pressing member presses the pressed portion upward to permit the photosensitive drum to be in contact with the endless belt. The frame has a positioning portion disposed above the pressing member and above the photosensitive drum. The positioning portion is configured to be in contact with the contacted portion and to position the photosensitive drum when the pressing member presses the pressed portion. The pressed portion is disposed farther from the drum body in an axial direction of the photosensitive drum than the contacted portion.

13 Claims, 10 Drawing Sheets

IMAGE FORMING APPARATUS INCLUDING ENDLESS BELT DISPOSED ABOVE PHOTOSENSITIVE DRUM

CROSS REFERENCE TO RELATED APPLICATION

This application is a continuation of U.S. application Ser. No. 13/432,473, filed Mar. 28, 2012, which claims priority from Japanese Patent Application No. 2011-141602 filed Jun. 27, 2011. The entire contents of the above-noted applications are incorporated herein by reference.

TECHNICAL FIELD

The present invention relates to an image forming apparatus such as a color laser printer.

BACKGROUND

As an electro-photographic type color laser printer, a tandem type color laser printer is known in which a plurality of photosensitive drums are juxtaposed with each other for the color of yellow, magenta, cyan and black.

In a conventional tandem type color laser printer, a belt unit having an endless belt is provided and photosensitive drums juxtaposed with each other are positioned above and in contact with the endless belt.

According to the conventional color printer, each process cartridge accommodating each photosensitive drum is detachably attached to a cartridge tray. The cartridge tray is inserted into an interior of a main casing of the printer while a door is opened, and is positioned above the endless belt. Then, a pressure member positioned above each process cartridge is pivotally moved downward in interlocking relation to the closing movement of the door. The main casing has a positioning portion for positioning the process cartridges relative to the endless belt and the main casing as a result of pressure application from the pressure members. Thus, each pressure member presses each process cartridge downward whereupon each photosensitive drum is brought into contact with the endless belt, and positioning of each photosensitive drum with respect to the endless belt and the main casing is attained.

Japanese Patent Application Publication 2010-244071 discloses a tandem type color printer in which photosensitive drums are positioned below an intermediate transfer belt in a form of an endless belt, and each photosensitive drum is configured to contact the intermediate transfer belt.

According to the color printer disclosed in '071 publication, a plurality of process cartridges each accommodating each photosensitive drum are positioned below the belt unit. Each photosensitive drum has an upper peripheral part exposed to the intermediate transfer belt through each process cartridge. Thus, each photosensitive drum is in contact with the intermediate transfer belt from below.

SUMMARY

In the tandem type color printer in which the photosensitive drums are positioned below the endless belt, the process cartridges must be lifted upward for positioning against gravity when the pressure member is used for pressing the process cartridge. Hence, if a pressuring region of the pressure member for pressing the process cartridge is remote from the belt in a vertical direction, a contact region and positioning of the photosensitive drum with respect to the belt may become instable. Such instability may be accelerated by external factor such as vibration and friction with the belt during image forming operation, and consequently, blur of output image may occur.

In view of the foregoing, it is an object of the present invention to provide an image forming apparatus capable of bringing a photosensitive drum into stable contact with a belt or a positioning portion provided in a main casing even if the photosensitive drum is positioned below a belt unit.

In order to attain the above and other objects, the present invention provides an image forming apparatus that may include a frame, a first photosensitive drum, an endless belt, and a first pressing member. The first photosensitive drum may have a rotational axis extending in an axial direction. The first photosensitive drum may be configured to rotate about the rotational axis. The first photosensitive drum may include a drum body and a first flange portion. The drum body may have one end portion in the axial direction. The first flange portion may be provided on the one end portion of the drum body. The first flange portion may have a first contacted portion and a first pressed portion. The endless belt may be disposed above the first photosensitive drum. The first pressing member may be configured to press the first pressed portion upward to permit the first photosensitive drum to be in contact with the endless belt. The frame may have a first positioning portion disposed above the first pressing member and above the first photosensitive drum. The first positioning portion may be configured to be in contact with the first contacted portion and to position the first photosensitive drum when the first pressing member presses the first pressed portion. The first pressed portion may be disposed farther from the drum body in the axial direction than the first contacted portion is.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
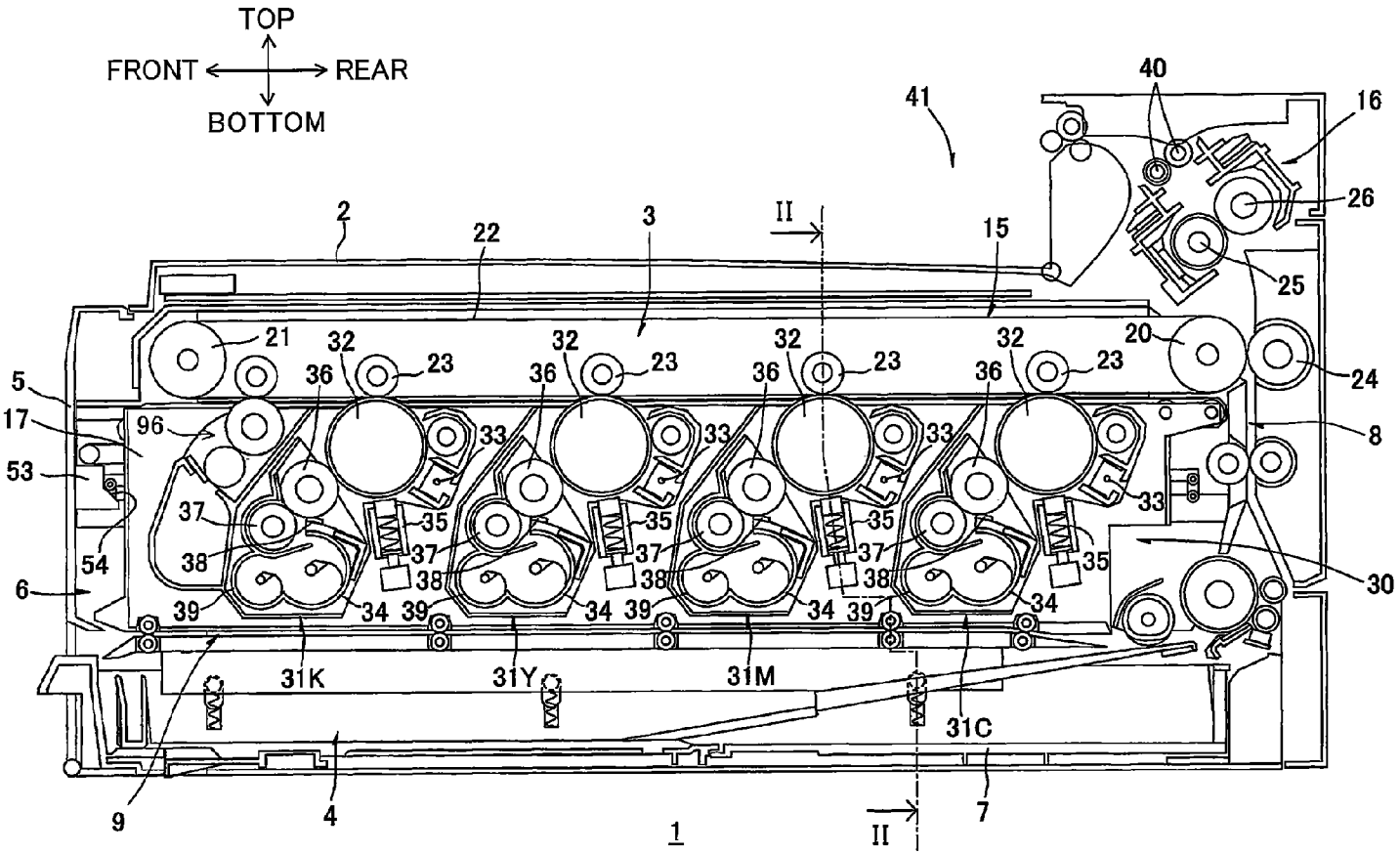
FIG. 1 is a cross-sectional side view of a color printer according to a first embodiment of the present invention.

An image forming apparatus according to a first embodiment of the present invention will be described while referring to FIGS. 1 through 8 wherein like parts and components are designated by the same reference numerals to avoid duplicating description.

1. Overall Structure of Color Printer

As shown in FIG. 1, the image forming apparatus according to the first embodiment is a horizontal intermediate transfer type color printer 1.

The color printer 1 includes a main casing 2 having an inner casing 51 for retaining an image forming unit 3 therein. Within the main casing 2, the image forming unit 3 and a sheet supply unit 4 are provided. The sheet supply unit 4 serves to supply sheets of paper to the image forming unit 3.

(1) Main Casing

The main casing 2 has a box shape that is substantially rectangular in a side view. The main casing 2 has a front wall in which an opening 6 is formed. The opening 6 provides communication between the interior and exterior of the main casing 2. A front cover 5 is provided on the front wall so as to be pivotally movable about a lower end thereof. The front cover 5 is movable between a closed position and an open position. In the open position, an upper end of the front cover 5 is spaced apart from the main casing 2 and opens the opening 6, while, in the closed position, the upper end of the front cover 5 is in abutment with the main casing 2 and closes the opening 6.

The terms "upward", "downward", "upper", "lower", "above", "below", "beneath", "right", "left", "front", "rear" and the like will be used throughout the description assuming that the color printer 1 is disposed in an orientation in which it is intended to be used. In the following description, the side of the color printer 1 on which the front cover 5 is provided (left side in FIG. 1) will be referred to as the front side of the color printer 1, and a side opposite to the front side (right side in FIG. 1) will be referred to as the rear side of the color printer 1. The top, bottom, left, and right sides of the color printer 1 in the following description will be based on the reference point of a user viewing the color printer 1 from the front side.

(2) Sheet Supply Unit

The sheet supply unit 4 includes a sheet supply tray 7 for accommodating sheets of paper therein. The sheet supply tray 7 is disposed at a bottom section of the main casing 2. The sheet supply tray 7 is detachably mounted in the main casing 2. A sheet supply path 8 is defined in the main casing 2. The sheet supply path 8 extends from a rear portion of the sheet supply tray 7 toward the image forming unit 3 (i.e. toward a position between a belt unit 15 (described later) and a secondary transfer roller 24 (described later)).

After the sheets accommodated in the sheet supply tray 7 are separated by various rollers on a sheet-by-sheet basis, each separated sheet is conveyed to the sheet supply path 8. While being guided by the sheet supply path 8, the sheet is conveyed to the image forming unit 3.

The sheet supply unit 4 also defines a manual sheet supply path 9. The manual sheet supply path 9 defines a passage between the sheet supply tray 7 and the image forming unit 3 for guiding the sheet extending in a frontward/downward direction.

The sheet inserted into the manual sheet supply path 9 from a front side of the main casing 2 is conveyed along the manual sheet supply path 9 toward a rear portion of the main casing 2. After being conveyed to the sheet supply path 8 from the manual sheet supply path 9, the sheet is conveyed to the image forming unit 3 along the sheet supply path 8.

(3) Image Forming Unit

The image forming unit 3 is disposed above the sheet supply unit 4. The image forming unit 3 includes a process unit 17, a belt unit 15, and a fixing unit 16.

(3-1) Process Unit

Within the main casing 2, the process unit 17 is disposed in an accommodating region 30 defined below the belt unit 15 and above the sheet supply unit 4.

The process unit 17 retains four process cartridges 31 corresponding to each color therein. Further, the process unit 17 is slidably movable in the frontward/downward direction between an internal position (FIGS. 7 and 8) in which the process unit 17 is positioned in the accommodating region 30 and an external position (FIG. 6) in which the process unit 17 is pulled outward of the main casing 2 when the front cover 5 is in the open position.

Four process cartridges 31 are arranged juxtaposed with and spaced apart from each other in the frontward/downward direction. More specifically, a black process cartridge 31K, a yellow process cartridge 31Y, a magenta process cartridge 31M, and a cyan process cartridge 31C are aligned in this order from front to rear.

Further, each process cartridge 31 includes a photosensitive drum 32, a Scorotron charger 33, and a developing unit 34.

The photosensitive drum 32 is cylindrical in shape extending in a rightward/leftward direction. The photosensitive drum 32 is rotatably supported to the process cartridges 31.

The Scorotron charger 33 is disposed diagonally below and rearward of the corresponding photosensitive drum 32, and confronts but does not contact the photosensitive drum 32.

The developing unit 34 is disposed diagonally below and frontward of the corresponding photosensitive drum 32. The developing unit 34 includes a developing roller 36.

The developing roller 36 is rotatably supported in an upper end of the corresponding developing unit 34. An upper rear edge of the developing roller 36 is exposed through an upper edge of the developing unit 34 and contacts the corresponding photosensitive drum 32 from below.

The developing unit 34 also includes a supply roller 37 for supplying toner to the corresponding developing roller 36 and a thickness-regulating blade 38 for regulating the thickness of the toner supplied to the developing roller 36. Further, the developing unit 34 includes a toner accommodating portion 39 for accommodating toner for a corresponding color therein. The toner accommodating portion 39 is disposed below the supply roller 37.

Further, the process unit 17 is provided with four LED units 35 in one-to-one correspondence with the four process cartridges 31.

The LED unit 35 is disposed rearward of the corresponding developing unit 34. Further, the LED unit 35 confronts the corresponding photosensitive drum 32 from below. The LED unit 35 is adapted to expose a surface of the corresponding photosensitive drum 32 based on image data.

Figure 2:
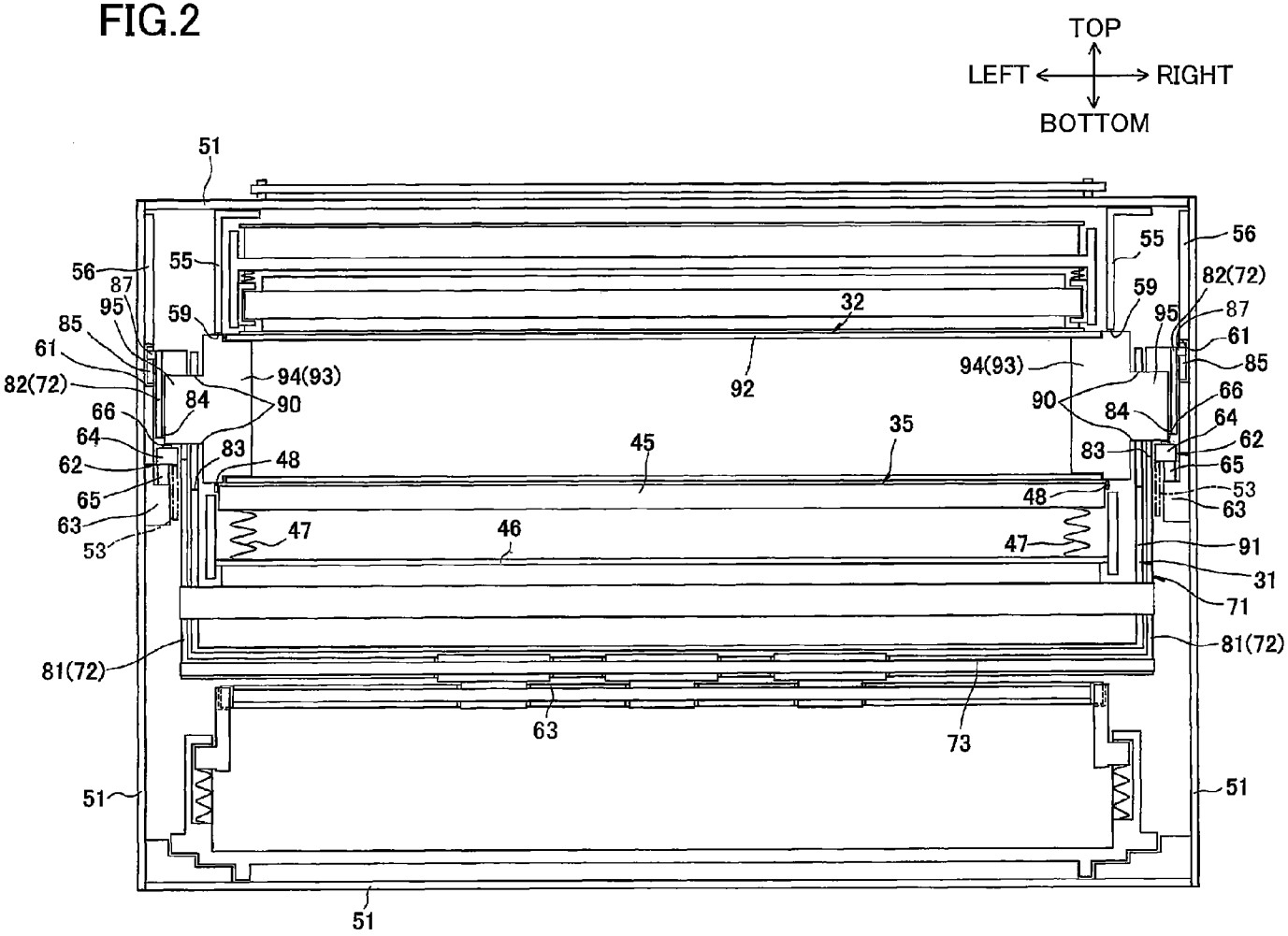
FIG. 2 is a cross-sectional view taken along a line II-II of FIG. 1.

As shown in FIG. 2, each LED unit 35 includes an LED array accommodating portion 46 and an LED array 45.

The LED array accommodating portion 46 is formed in a generally rectangular frame shape having a bottom wall and elongated in the rightward/leftward direction.

The LED array 45 is formed in an elongated beam shape extending in the rightward/leftward direction. The LED array 45 integrally retains a plurality of LEDs arrayed in the rightward/leftward direction. The LED array 45 has a lower portion that is accommodated in an upper portion of the LED array accommodating portion 46. The LED array 45 is movable relative to the LED array accommodating portion 46. The LED array 45 is resiliently supported to the bottom wall of the LED array accommodating section 46 by a pair of right and left compression springs 47 positioned between the bottom wall of the LED array accommodating portion 46 and the LED array 45.

The LED array 45 has right and left ends, each having an LED positioning member 48 for positioning the LED array 45 relative to the corresponding photosensitive drum 32.

Each LED positioning member 48 is formed in a plate shape that is substantially rectangular in a side view. The LED positioning members 48 are arranged to slightly protrude upward from the respective right and left edges of the LED array 45. The LED positioning members 48 are urged upward by the compression springs 47, thereby contacting the corresponding photosensitive drum 32 from below. Hence, The LED array 45 is subjected to positioning relative to the photosensitive drum 32 such that the LED array 45 is in confrontation with the photosensitive drum 32 at a regular interval therebetween (at a distance corresponding to a protruding length of the LED positioning members 48) even if the photosensitive drum 32 is moved in a upward/downward direction (i.e. a vertical direction) as will be described later.

(3-2) Belt Unit

As shown in FIG. 1, the belt unit 15 is disposed in a topmost portion of the main casing 2.

The belt unit 15 includes a drive roller 20, a follow roller 21, an intermediate transfer belt 22, and four primary transfer rollers 23.

The drive roller 20 and the follow roller 21 are in confrontation with and spaced apart from each other in the frontward/rearward direction.

The intermediate transfer belt 22 is an endless belt. The intermediate transfer belt 22 is stretched around the drive roller 20 and the follow roller 21. When the drive roller 20 is driven to rotate, the intermediate transfer belt 22 circulates such that a lower portion of the intermediate transfer belt 22 moves in a rearward direction.

The primary transfer rollers 23 are juxtaposed with and spaced apart from each other in the frontward/rearward direction. The primary transfer rollers 23 are disposed so as to confront the corresponding photosensitive drum 32 with the lower portion of the intermediate transfer belt 22 interposed therebetween.

The secondary transfer roller 24 is disposed rearward of the belt unit 15.

The secondary transfer roller 24 confronts the drive roller 20 of the belt unit 15 with interposing the intermediate transfer belt 22 therebetween.

(3-2) Fixing Unit

The fixing unit 16 is disposed above the secondary transfer roller 24. The fixing unit 16 includes a heating roller 25 and a pressure roller 26 in confrontation with the heating roller 25.

(3-3) Image Forming Operations (3-3-1) Developing Operation

The toner accommodated in the toner accommodating section 39 of the developing unit 22 is supplied to the supply roller 37, and then to the developing roller 36.

As the developing roller 36 rotates, the thickness-regulating blade 38 regulates the toner carried on the surface of the developing roller 36 to a prescribed thickness, so that the developing roller 36 carries a uniform thin layer of toner thereon. The toner supplied to the developing roller 36 is positively tribocharged between the thickness-regulating blade 38 and the developing roller 36.

In the meantime, the Scorotron charger 33 applies uniform charge of positive polarity to a surface of the corresponding photosensitive drum 32 as the photosensitive drum 32 rotates. Subsequently, the LED unit 35 exposes the surface of the corresponding photosensitive drum 32. An electrostatic latent image corresponding to an image to be formed on the sheet is formed on the surface of the photosensitive drum 32.

As the photosensitive drum 32 continues to rotate, the positively charged toner carried on the surface of the developing roller 36 is supplied to the electrostatic latent image formed on the surface of the photosensitive drum 32, thereby developing the electrostatic latent image into a visible toner image through reverse development. Thus, the toner image is formed on the surface of the photosensitive drum 32.

(3-3-2) Transfer and Fixing Operations

The toner image formed on the surface of each photosensitive drum 32 through reverse development is primary-transferred onto the lower portion of the intermediate transfer belt 22 conveyed rearward, thereby forming a color image on the intermediate transfer belt 22.

When the color image formed on the intermediate transfer belt 22 reaches a confronting position where the intermediate transfer belt 22 confronts the secondary transfer roller 24 in association with circular movement of the intermediate transfer belt 22, the sheet is supplied to the confronting position from the sheet supply unit 4 (alternatively, the manual sheet supply path 9) at a suitable timing of movement of the color image. As the intermediate transfer belt 22 continues to circularly move, the color image formed on the intermediate transfer belt 22 is secondary-transferred onto the sheet.

The color image transferred onto the sheet is thermally fixed to the sheet by heat and pressure in the fixing unit 16, while the sheet passes between the heating roller 25 and the pressure roller 26.

(4) Discharge

After the color image has been fixed to the sheet in the fixing unit 16, the sheet is discharged by discharge rollers 40 onto a discharge tray 41 formed on a top surface of the main casing 2.

2. Main Casing (1) Front Cover

The front cover 5 has an inner surface on which a pair of interlocking members 53 is provided. Each of the interlocking members 53 is provided at each lateral end portion of the middle portion in the upward/downward direction of the front cover 5 when the front cover 5 is at its closed position. Each interlocking member 53 protrudes rearward from the inner surface of the front cover 5 when the front cover 5 is in the closed position, and is generally rectangular shaped.

More specifically, each interlocking member 53 has a rear end surface including a flat surface (shown without a reference numeral) and a sloped surface 54. The flat surface occupies a substantially upper-half portion of the rear end surface of the interlocking member 53 and extends in the upward/downward direction. The sloped surface 54 extends from a lower end portion of the flat surface diagonally downward and rearward.

(2) Details of Main Casing

As shown in FIG. 2, within the main casing 2, the inner casing 51 is provided. The inner casing 51 is formed in a box-shape and made of a material having high rigidity, such as a steel plate. Further, within the inner casing 51, a pair of right and left first frames 55 and a pair of right and left second frames 56 are provided.

(2-1) First Frame

The pair of first frames 55 is disposed at an upper portion of the main casing 2. The right first frame 55 is disposed at a right side of the belt unit 15 and the left first frame 55 is disposed at a left side of the belt unit 15. Each first frame 55 is formed in a generally rectangular flat plate shape and elongated in the frontward/rearward direction.

The pair of first frames 55 is arranged spaced apart from each other with the belt unit 15 interposed therebetween such that the pair of first frames 55 confronts each photosensitive drum 32 in the upward/downward direction at a position outside of a sheet contacting region of each photosensitive drum 32 in the rightward/leftward direction. (Here, the sheet contacting region implies a region of the photosensitive drum 32 where the sheet contacts.) Each first frame 55 has an upper end portion fixed to a top wall of the inner casing 51.

Each first frame 55 has a lower portion in which four drum positioning recesses 59 (FIG. 3) in one-to-one correspondence with the four photosensitive drums 32.

Each drum positioning recess 59 is a substantially U-shaped notch having a bottom open. More specifically, the drum positioning recess 59 is depressed upward from a lower edge of the first frame 55. The four drum positioning recesses 59 are arranged juxtaposed with and spaced apart from each other in the frontward/rearward direction. Upper portions of right and left ends of the photosensitive drum 32 are supported in the drum positioning recesses 59 formed in the right and left first frames 55.

(2-2) Second Frame

Each of the right and left second frames 56 is formed in a flat plate shape extending in the frontward/rearward direction along right and left side plates of the inner casing 51. Further, each second frame 56 extends in the upward/downward direction from a position of the upper end portion of the first frame 55 toward a position lower than the photosensitive drum 32.

Each second frame 56 is formed with a guide groove 61 for guiding sliding movement of the process unit 17 and is provided with a movable link member 64, and a linkage mechanism 62.

(2-2-1) Guide Groove

The guide groove 61 has a sufficient vertical length capable of receiving rollers 85 (described later) provided at the process unit 17. The guide groove 61 extends linearly in the frontward/rearward direction and is formed across substantially the entire frontward/rearward length of the second frame 56.

Figure 3:
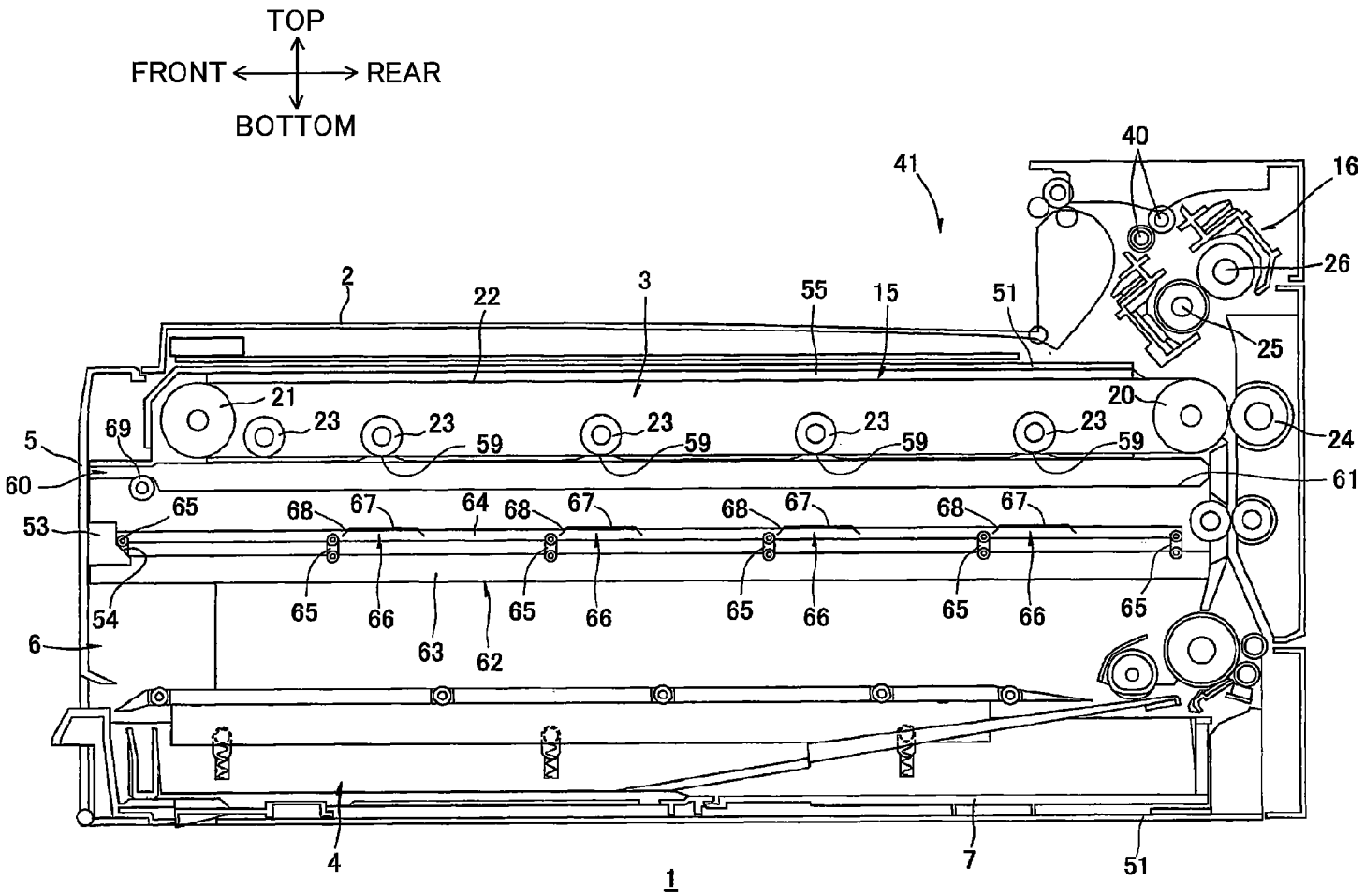
FIG. 3 is a cross-sectional side view of the color printer of FIG. 1 particularly showing a linkage mechanism.
Figure 4:
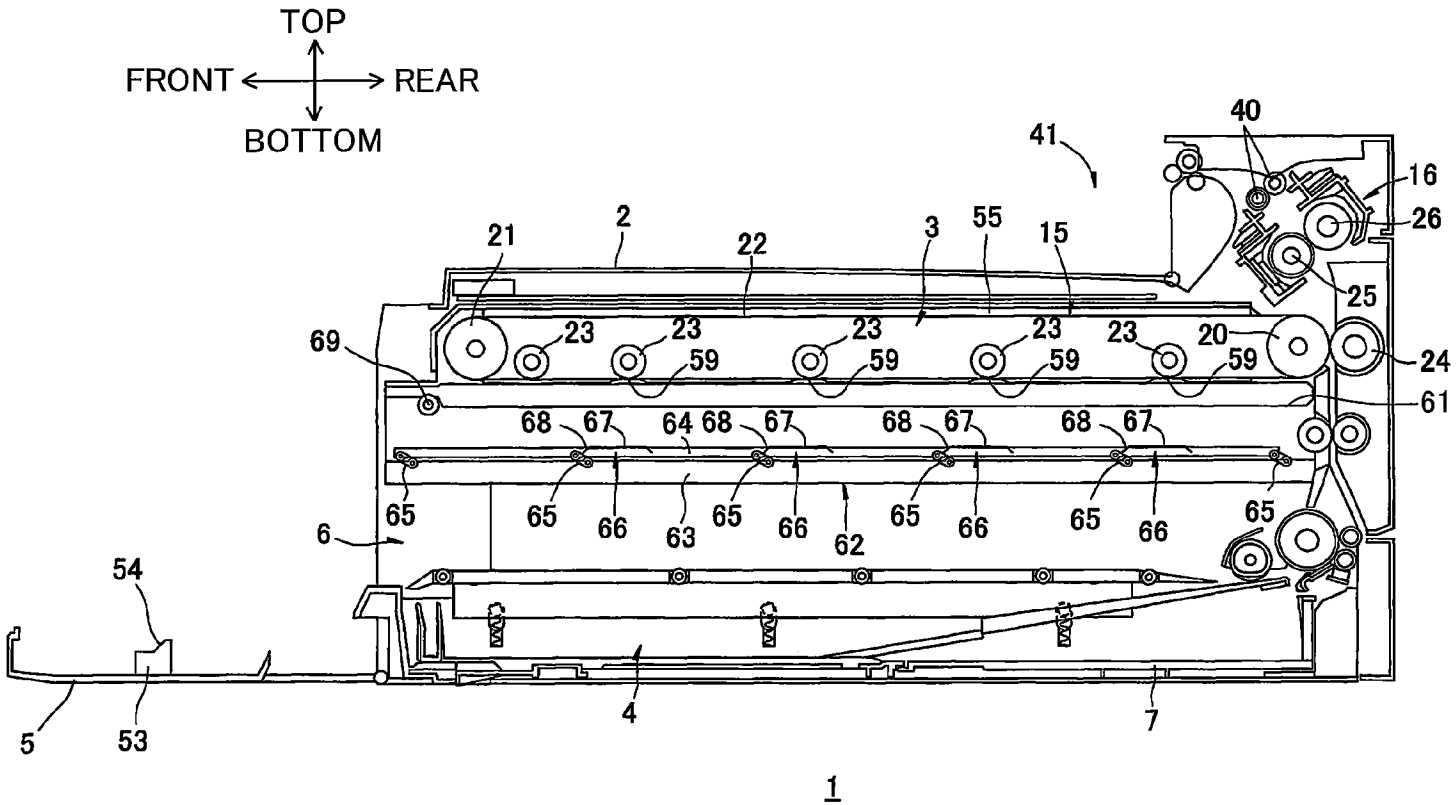
FIG. 4 is a cross-sectional side view of the color printer according to the first embodiment, wherein a front cover of the color printer is in an open position.

As shown in FIG. 3, the guide groove 61 has a front end portion provided with a retaining portion (not shown) having a vertical length smaller than a diameter of the roller 85, and a roller 69. A lower side of the front end portion of the guide groove 61 is projected upward to form the retaining portion 60.

(2-2-1) Movable Link Member

Totally four leaf springs 66 as urging members are provided. Each leaf spring 66 is provided at the movable link member 64 and extends in the frontward/rearward direction. The leaf springs 66 are arrayed in the frontward/rearward direction, and neighboring leaf springs 66 are spaced away from each other.

Each leaf spring 66 has a pressure portion 67 in a plate shape and extending in the frontward/rearward direction, and a leg portion 68 integral with the pressure portion 67 and extending from each end of the pressure portion 67. The leg portion 68 is fixed to an upper surface of the movable link member 64. Thus, the pressure portion 67 is positioned in confrontation with and spaced away from the upper surface of the movable link member 64. Each pressure portion 67 provides resilient urging force directing upward against a force applied downward to the pressure portion 67.

The movable link member 64 is positioned above a fixed link member 63 (described later). The movable link member 64 has an elongated beam shape, extending in the frontward/rearward direction to span an entire length of the second frame 56 in the frontward/rearward direction.

Each movable link member 64 has a front end portion on which a cylindrical-shaped boss (not shown) is formed. Each boss protrudes laterally inward in the rightward/leftward direction.

(2-2-3) Linkage Mechanism

As shown in FIGS. 2 and 3, the linkage mechanism 62 is provided below the guide groove 61. Each linkage mechanism 62 is disposed at a position confronting each interlocking member 53 of the front cover 5 in the frontward/rearward direction. Each linkage mechanism 62 includes the fixed link member 63 (as a base portion) and six joint members 65.

The fixed link member 63 is integrally formed with the second frame 56 and has a flat plate shape extending over the entire length of the second frame 56 in the frontward/rearward direction.

The fixed link member 63 has a length (a protruding length) shorter than that of the movable link member 64 in the rightward/leftward direction. In other words, an inner end portion of the movable link member 64 is positioned (protrudes) inward of an inner end portion of the fixed link member 63 in the in the lateral direction.

Six joint members 65 are provided for each movable link member 64. The joint members 65 are arrayed in the frontward/rearward direction with a space between neighboring joint members 65. Each joint member 65 is oblong shaped in side view. One longitudinal end portion of each joint member 65 is pivotally movably connected to the fixed link member 63, and another longitudinal end portion thereof is pivotally movably connected to the movable link member 64. Thus, the joint member 65 is movable between an upstanding posture (FIG. 3) upstanding from the fixed link member 63 in which a major axis of the joint member extends in a vertical direction, and a droopy posture (FIG. 4) tilting forward from the upstanding posture.

Connecting portions of the joint members 65 to the fixed link member 63 are positioned at an equal interval, and connecting portions of the joint members 65 to the movable link member 64 are positioned at an equal interval. Thus, the movable link member 64 is movable relative to the fixed link member 63 maintaining parallelism therebetween.

Figure 8:
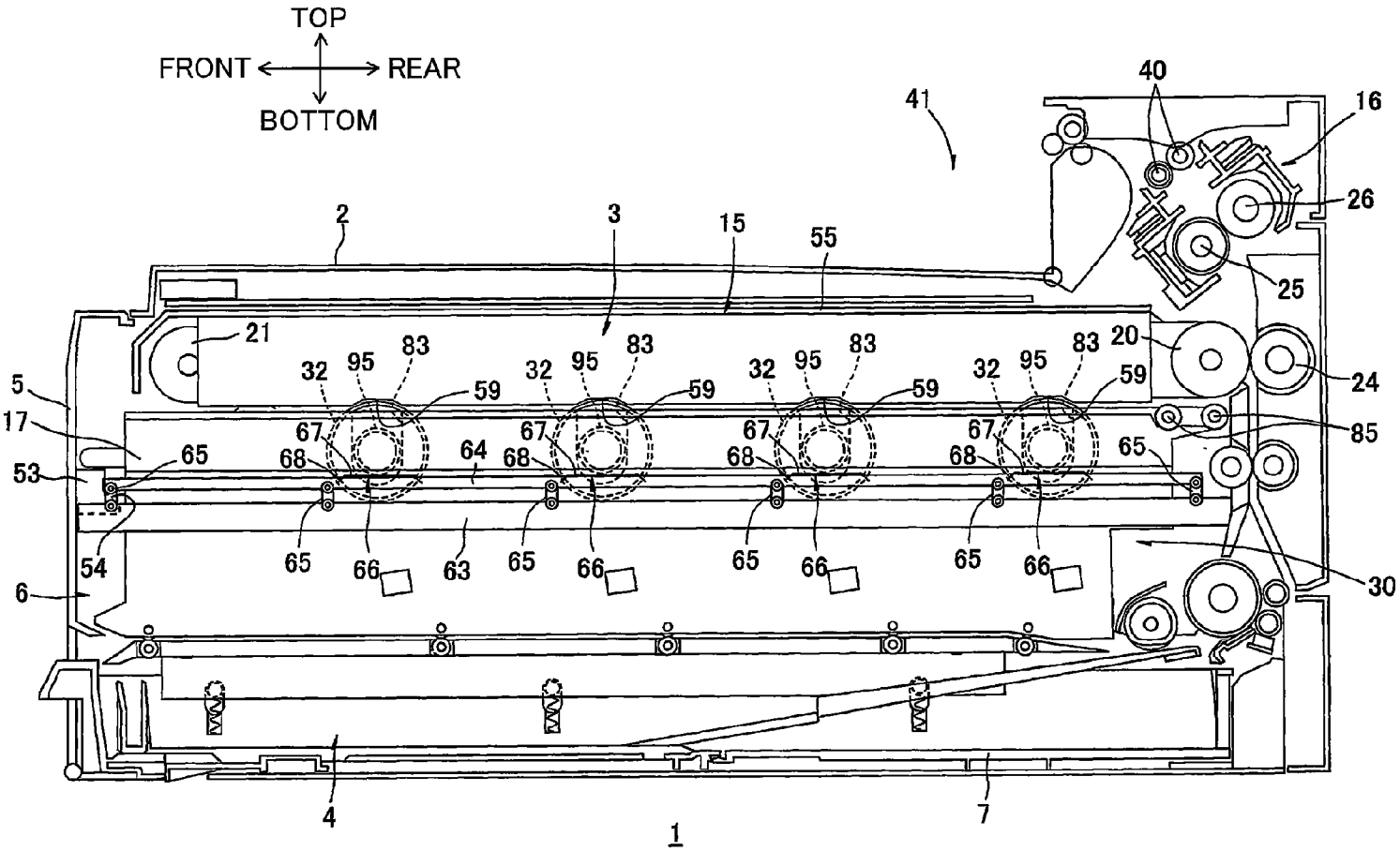
FIG. 8 is a cross-sectional side view for description of pressing operation of the linkage mechanism in the color printer according to the first embodiment.

More specifically, the movable link member 64 is spaced away from the fixed link member 63 and extends in a direction parallel to the fixed link member 63 when the joint members 65 are at their upstanding posture. In this case, the leaf springs 66 are positioned at pressing position for pressing the shaft portion 95 of each flange portion 93 (FIG. 8).

On the other hand, the movable link member 64 is moved toward the fixed link member 63 while maintaining parallelism therebetween when the joint members 65 are moving to the droopy posture. Thus, a gap between the movable link member 64 and the fixed link member 63 becomes small.

Then, the leaf springs 66 are positioned to their retracted position releasing pressing force to the shaft portion 95 of each flange portion 93 when the joint members 65 reach the droopy posture while maintaining parallelism between the movable link member 64 and the fixed link member 63 (FIG.

7). In this way, the movable link member 64 and the linkage mechanism 62 constitute a parallelogram linkage mechanism.

Among the six joint members 65, the other end portion of a front-most joint member 65 is connected to a front end portion of the movable link member 64, and the other end portion of a rearmost joint member 65 is connected to a rear end portion of the movable link member 64. Remaining four joint members 65 have their other end portions spaced away from each other at an intermediate portion of the movable link member 64, and each other end portion is positioned ahead of and adjacent to each leaf spring 66.

3. Process Unit

The process unit 17 includes a process frame 71 for integrally retaining the plurality of process cartridges 31 and the plurality of LED units 35 therein.

(1) Process Frame

Figure 5:
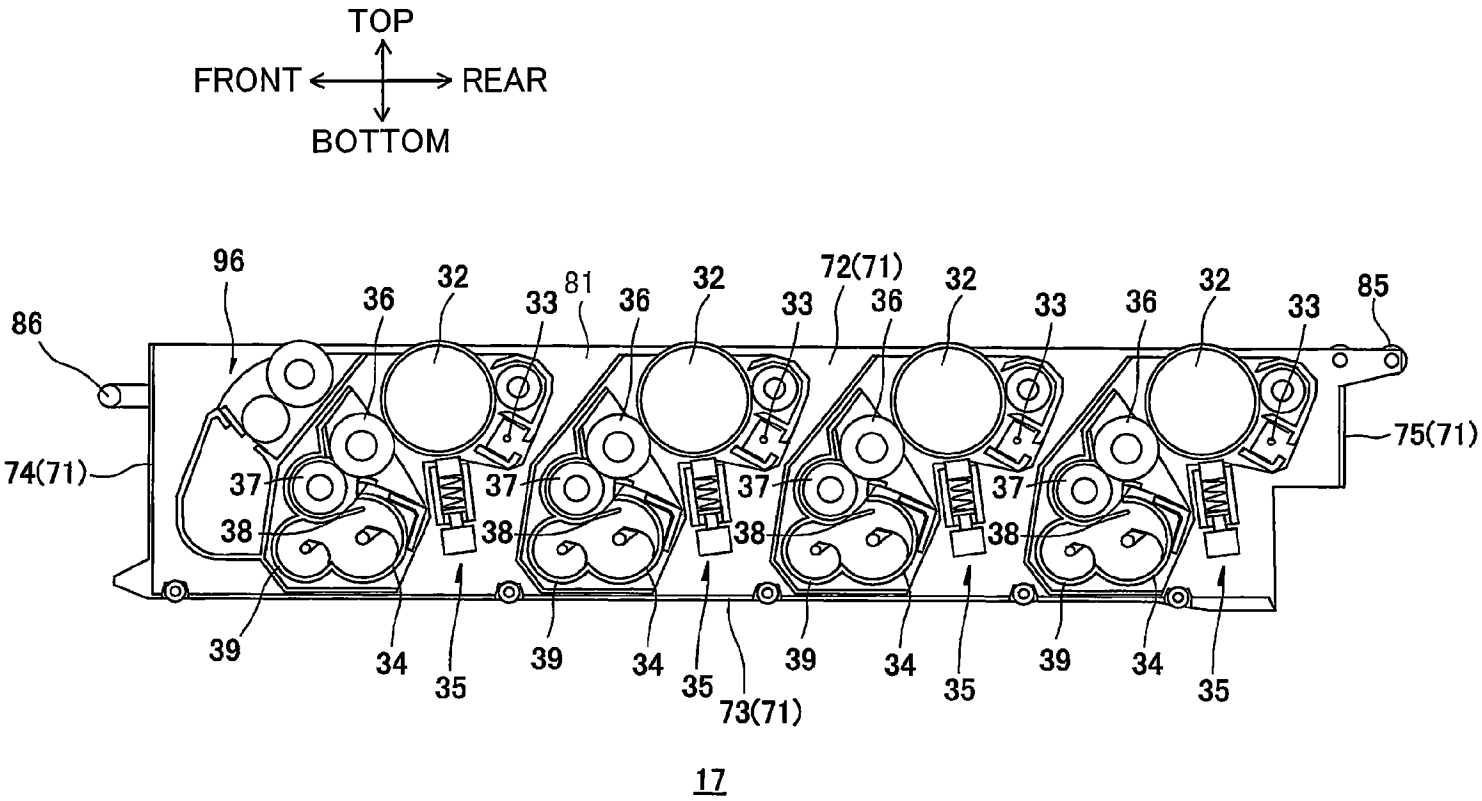
FIG. 5 is a cross-sectional side view of a process unit to be accommodated in the color printer according to the first embodiment.

As shown in FIGS. 2 and 5, the process frame 71 is formed in a generally rectangular frame shape with a bottom wall. The process frame 71 has a pair of right and left side plates 72, a bottom plate 73, and a front plate 74, and a rear plate 75. The pair of side plates 72, the bottom plate 73, the front plate 74, and the rear plate 75 are integral with one another. The side plates 72 are arranged in confrontation with and spaced apart from each other in the rightward/leftward direction. The bottom plate 73 bridges between lower edges of the side plates 72. The front plate 74 bridges between front edges of the side plates 72. The rear plate 75 bridges between rear edges of the side plates 72.

Each side plate 72 includes a first side plate 81 and a second side plate 82.

Figure 7:
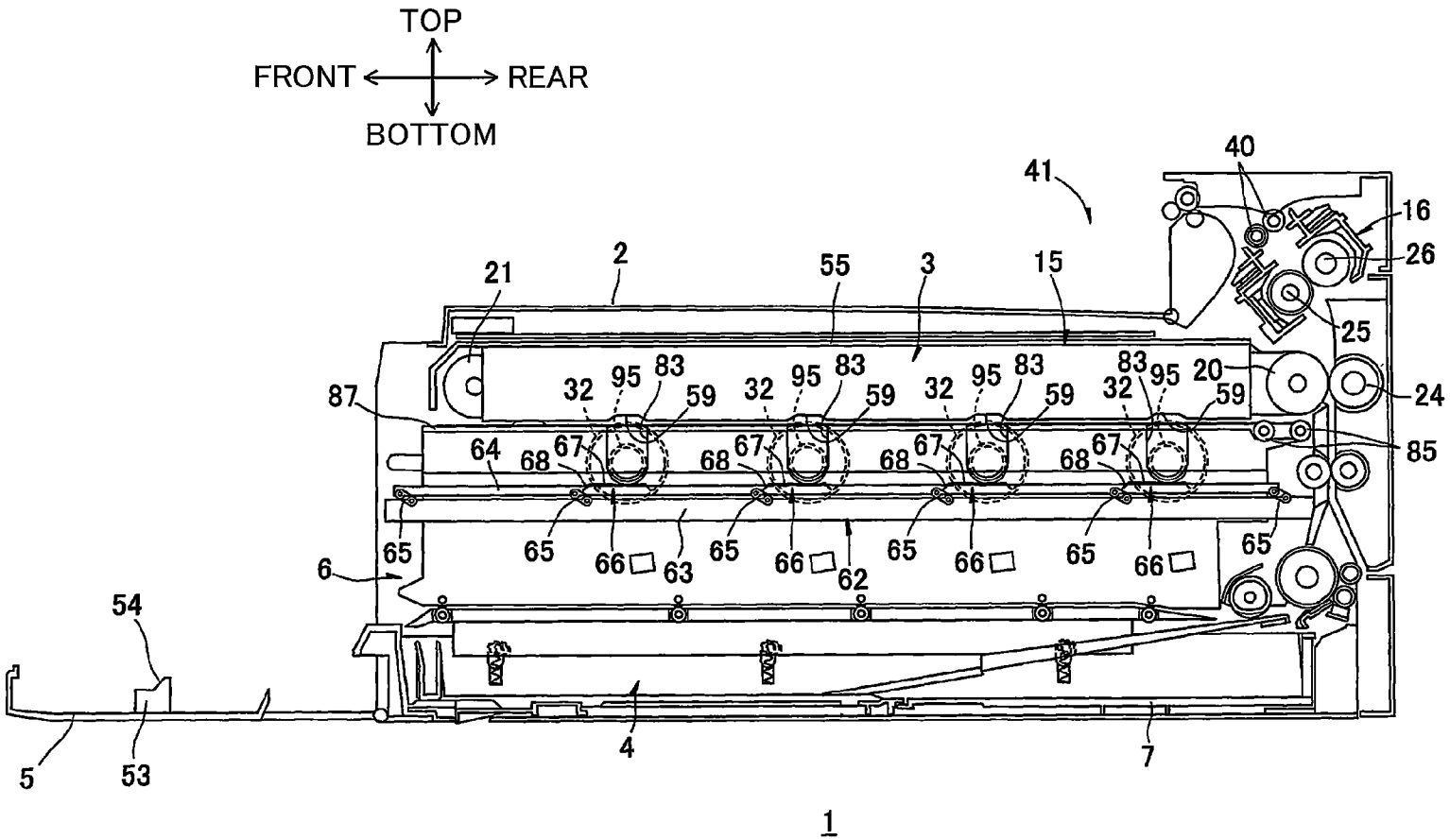
FIG. 7 is a cross-sectional side view for description of accommodating operation of the process unit in the color printer according to the first embodiment.

As shown in FIG. 7, the first side plate 81 is formed in a flat plate shape extending in the frontward/rearward direction and in the upward/downward direction. The first side plate 81 is formed with four shaft supporting notches 83 at positions corresponding to the four photosensitive drums 32 supported to the respective process cartridges 31. Each shaft supporting notch 83 is formed in a substantially U-shape having a top open. More specifically, the shaft supporting notch 83 is depressed downward from an upper edge of the first side plate 81.

The second side plate 82 is formed in a flat plate shape extending in the frontward/rearward direction and in the upward/downward direction. The second side plate 82 confronts an upper portion of the first side plate 81 in the rightward/leftward direction and is positioned laterally outward of the first side plate 81. More specifically, the second side plate 82 has a frontward/rearward length substantially equal to that of the first side plate 81. Further, the second side plate 82 has a vertical length smaller than that of the first side plate 81. Further, the second side plate 82 has an upper edge in flush with an upper edge of the first side plate 81 in the upward/downward direction and has a lower edge positioned upward of a lower edge of the shaft supporting notch 83.

Each side plate 72 has front and rear end portions on each of which a flat-shaped connecting plate (not shown) is provided. Each connecting plate connects the first side plate 81 to the second side plate 82.

Four openings 84 each extending in the frontward/rearward direction are formed on the connecting plate. Four openings 84 are in one-to-one correspondence with the four photosensitive drums 32.

Each second side plate 82 has an outer surface on which rollers 85 are provided. Specifically, the rollers 85 are disposed at an upper-rear end portion of the outer surface of each second side plate 82 such that each roller 85 is rotatable about a roller shaft (not shown) extending laterally outwardly from the second side plate 82.

Each second side plate 82 has an upper end portion provided with a guide rib 87 extending in the frontward/rearward direction over a length of the second side plate 82.

The front plate 74 is provided with a generally U-shaped hand grip portion 86. Each end of each arm of "U" is connected to a front surface of the front plate 74, and a bottom of the "U" is positioned ahead of the front plate 74.

(2) Process Cartridge

Each process cartridge 31 has a cartridge frame 91 formed in a top open box shape, and, within the cartridge frame 91, the photosensitive drum 32, the charger 33 (FIG. 1), and the developing unit 34 (FIG. 1) are provided.

The cartridge frame 91 has a pair of right and left side plates, each formed with a shaft supporting hole 90 at a position confronting the photosensitive drum 32 in the rightward/leftward direction.

The photosensitive drum 32 includes a cylindrical drum body 92 and flange portions 93 fixedly (non-rotatably) fitted in respective right and left ends of the drum body 92.

The drum body 92 has a top layer made from a photosensitive layer with positive charging characteristic.

Each flange portion 93 is provided with an insertion portion 94 and a shaft portion 95 integral with the insertion portion 94. The insertion portion 94 is cylindrical in shape and press-fitted in the drum body 92. The shaft portion 95 is coaxial with the insertion portion 94 and is cylindrical in shape. The shaft portion 95 has an outer diameter smaller than that of the insertion portion 94 and substantially equal to an inner diameter of the shaft supporting hole 90 formed in the cartridge frame 91. The shaft portion 95 is supported in the shaft supporting hole 90 and rotatable relative to the cartridge frame 91.

With this configuration, the photosensitive drum 32 is supported to the cartridge frame 91via the shaft portions 95 of the flange portions 93 and rotatable relative to the cartridge frame 91.

Further, as shown in FIG. 5, the black process cartridges 31K is integrally provided with a belt cleaning unit 96 at a position frontward of the developing unit 34. The belt cleaning unit 96 is adapted for cleaning the intermediate transfer belt 22.

4. Mounting Operation of Process Cartridge Relative to Process Unit

Figure 6:
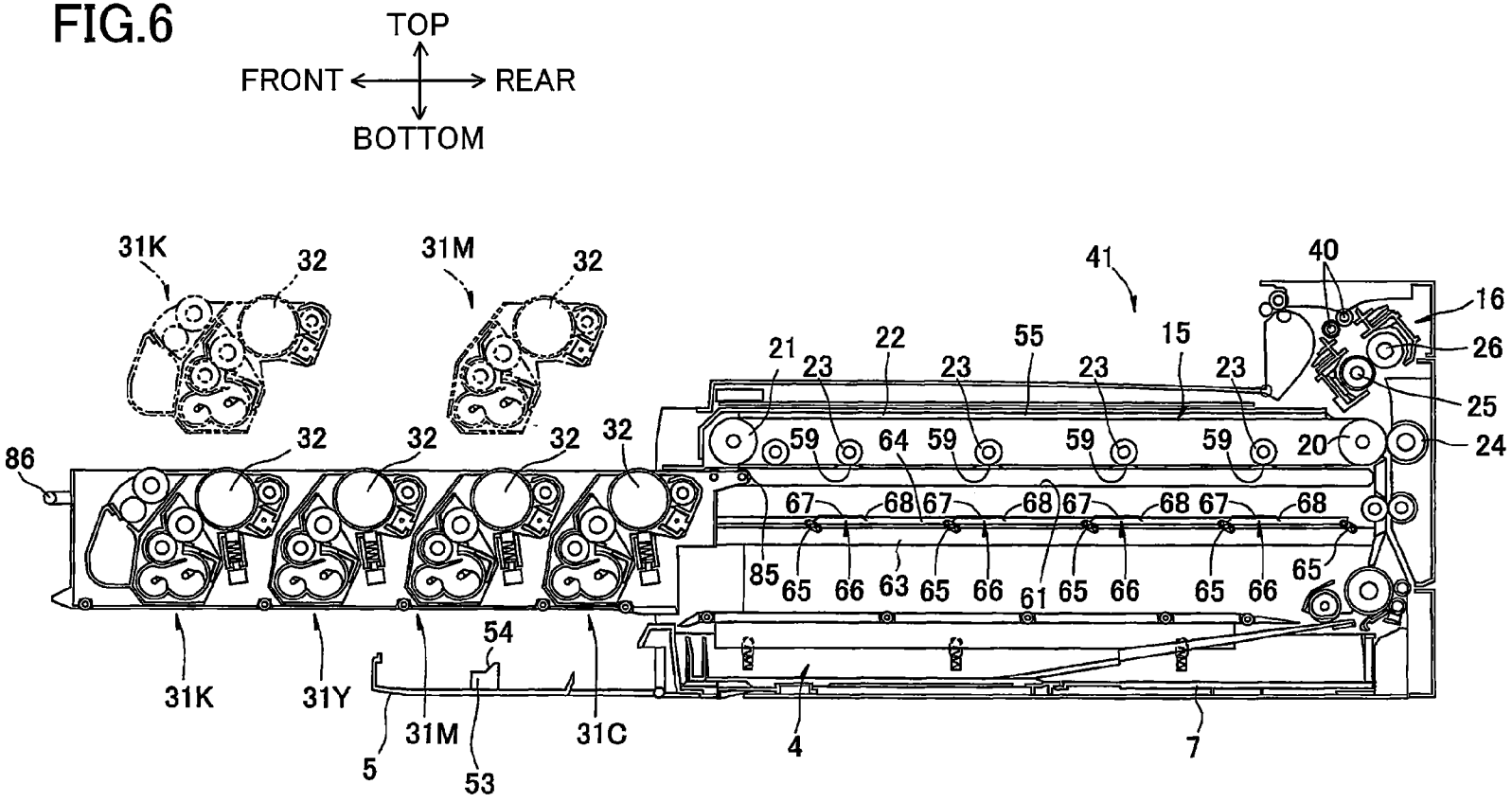
FIG. 6 is a cross-sectional side view for description of attachment and detachment of a process cartridge in the color printer according to the first embodiment.

As shown in FIG. 6, a mounting operation of the process cartridges 31 relative to the process unit 17 is performed when the process unit 17 is in the external position where the process unit 17 is pulled outward of the main casing 2.

At this time, the front cover 5 is in the open position where the upper end (free end) of the front cover 5 is spaced apart from the main casing 2 and inclined forward and downward.

Further, the joint member 65 is at its droopy posture, so that the movable link member 64 is in the retracted position to release pressing force of the leaf spring 66 to the shaft portion 95.

Initially, the process cartridge 31 is positioned above the process unit 17. The process cartridge 31 has a posture such that the photosensitive drum 32 is positioned above the toner accommodating section 39.

Then, the process cartridge 31 is moved downward, so that the process cartridge 31 enters between the right and left side plates 72 of the process frame 71. When the process cartridge 31 is further moved downward, the shaft portions 95 of the flange portions 93 provided in the photosensitive drum 32 are inserted into the shaft supporting notches 83 formed in the first side plates 81 of the right and left side plates 72, and brought into abutment with the lower portions of the shaft supporting notches 83, respectively. Abutment of the shaft portions 95 with the lower portions of the shaft supporting notches 83 restricts further downward movement of the process cartridge 31. As a result, mounting of the process cartridge 31 in the process unit 17 is completed. At this time, the shaft portion 95 of each flange portion 93 provided in the photosensitive drum 32 protrudes laterally outward from the guide grooves 83 of the first side plate 81 in the rightward/leftward direction.

When the process cartridge 31 has been mounted in the process unit 17, each shaft portion 95 of the flange portion 93 is positioned such that a distal end portion of the shaft portion 95 is located between the first side plate 81 and the second side plate 82. Hence, the shaft portion 95 is exposed downward to an outside through the opening 84 of each side plate 72.

5. Mounting Operation of Process Unit Relative to Main Casing

As shown in FIG. 6, a mounting operation of the process unit 17 relative to the main casing 2 is performed when all of four process cartridges 31 have been mounted in the process unit 17. That is, when all of four process cartridges 31 have been mounted in the process unit 17, the process unit 17 is moved to the internal position from the external position. When the process unit 17 is in the external position, the rollers 85 of each second side plate 82 of the side plate 72 are positioned in the front end portion of the corresponding guide groove 61 formed in the inner casing 51.

Initially, the user holds the handle 86 of the process unit 17 to move the process unit 17 rearward. With this movement, the rollers 85 are rollingly moved rearward along the guide groove 61. Further, the guide rib 87 is guided rearward on the roller 69 supported to the main casing. Then, when the process unit 17 is moved rearward until the rear side rollers 85 reach rear ends of the corresponding guide grooves 61, further rearward movement of the process unit 17 is restricted. As a result, movement of the process unit 17 to the internal position has been completed.

When the process unit 17 is at its internal position, the linkage mechanism 62 and the leaf springs 66 provided on each second frame 56 are positioned laterally outward of the first side plate 81 and are in confrontation with the openings 84 from below (see FIG. 2).

The flange portion 93 (the shaft portion 95) of each photosensitive drum 32 is placed on the pressure portion 67 of the corresponding leaf spring 66.

The shaft portion 95 of the flange portion 93 is coupled to the corresponding shaft supporting hole 90 of the cartridge frame 91.

The flange portion 93 of each photosensitive drum 32 is positioned below and spaced away from the positioning recess 59 of the first frame 55.

6. Pressing Operation by Linkage Mechanism

Then, the front cover 5 is pivotally moved to the closed position from the open position. In accordance with the pivotal movement of the front cover 5, a bottom end portion of the sloped surface 54 is brought into abutment with the boss (not shown) provided at the movable link member 64 from frontward thereof.

The front cover 5 is further moved rearward toward its closed position, the boss moves along the sloped surface 54 upward in accordance with the pivotal movement of the front cover 5. Since each one end of the joint member 65 connected to the fixed link member 63 has been positioned rearward of each other end of the joint member 65 connected to the movable link member 64, each joint member 65 is pivotally moved rearward about each one end of each joint member 65. Thus, the boss and the movable link member 64 are moved integrally rearward and upward.

Further, in accordance with the movement of the movable link member 64 rearward and upward, the flange portion 93 of each photosensitive drum 32 disposed on the pressure portion 67 of the corresponding leaf spring 66 is moved upward toward the first frame 55. Thus, the process cartridges 31 are lifted upward via the respective flange portions 93.

When the front cover 5 is further moved toward the closed position, the boss (not shown) reaches an upper end of the sloped surface 54. At this time, the front cover 5 is in the closed position where the upper end of the front cover 5 is in abutment with the main casing 2. Each joint member 65 is at its upstanding position for maintaining the movable link member 64 at the pressing position.

Each flange portion 93 is entered into the corresponding positioning groove 59 of the first frame 55, and is in contact with the first frame 55 from below.

Thus, the outer peripheral surface of the photosensitive drum 32 is brought into contact with the intermediate transfer belt 22 of the belt unit 15 from below. Accordingly, positioning of the photosensitive drum 32 relative to the belt unit 15 can be achieved.

Incidentally, pressure release with respect to the photosensitive drum 32 by means of the linkage mechanism 62 can be achieved by reversing the above-described procedure. That is, by moving the front cover 5 from the closed position to the open position, the boss (not shown) moves along the sloped surface 54 downward, thereby moving the movable link member 64 frontward and downward. Because the flange portion 93 (the shaft portion 95) of the photosensitive drum 32 is positioned on the leaf spring 66 provided on the movable link member 64, the photosensitive drum 32 is moved downward in accordance with the movement of the movable link member 64, and is moved away from the first frame 55.

As a result, urging force of the leaf spring 66 to the photosensitive drum 32 is shut off, and thereafter, the process unit 17 can be pulled outward by gripping and pulling the hand grip portion 86.

7. Advantageous Effects (1) According to the color printer 1, the leaf spring 66 is configured to upwardly urge the flange portion 93 of the photosensitive drum 32 when the process unit 17 is in the internal position. Accordingly, the photosensitive drum 32 in its entirety can be lifted toward the belt unit 15. Thus, the photosensitive drum 32 can be brought into contact with the intermediate transfer belt 22 of the belt unit 15.

The flange portion 93 is provided at each lateral end portion of the photosensitive drum 32. Hence, the pressing force transmitted to the flange portions 93 attributed to the urging force of the leaf spring 66 can be efficiently transmitted to the photosensitive drum 32. Each photosensitive drum 32 is applied with the pressing force in a balanced manner with respect to an axial direction of the photosensitive drum 32.

As a result, the photosensitive drum 32 can be stably in contact with and positioned relative to the intermediate transfer belt 22 in a construction where the photosensitive drum 32 is positioned below the belt unit 15.

(2) The rollers 85 and the guide rib 87 are provided at each second side plate 82 of the process unit 17. Therefore, the process unit 17 can smoothly move between the internal position and the external position. Further, since the guide rib 87 is formed on the second side plate 82, the guide rib 87 does not interfere with the movement of the process unit 17.

(3) The leaf spring 66 is disposed is confrontation with the corresponding opening 84 formed between the first side plate 81 and the second side plate 82 from below. Therefore, the leaf spring 66 can reliably apply the urging force to the flange portion 93 of the photosensitive drum 32 that is received at the receiving groove 83 of the first side plate 81.

(4) Each leaf spring 66 is connected to the movable link member 64 and the linkage mechanism 62 is configured to move the movable link member 64 between the pressing position and the retracted position. Therefore, the leaf springs 66 can be moved collectively by the linkage mechanism 62.

(5) Further, the linkage mechanism 62 includes the fixed link member 63 disposed in confrontation with the movable link member 64, and the joint members 65 connecting the movable link member 64 to the fixed link member 63 and allowing the movable link member 64 to be moved with respect to the fixed link member 63. Therefore, movement of the movable link member 64 between the pressing position and the retracting position is attainable with a simple construction.

(6) Further, each joint member 65 is provided for the shaft portion 95 of each photosensitive drum 32. Therefore, local bending of the movable link member 64 at a position adjacent to the shaft portion 95 of the photosensitive drum 32 can be prevented, and the shaft portion 95 of the photosensitive drum 32 can be pressed stably by the leaf springs 66 when the movable link member 64 is moved to the pressing position.

(7) Further, the interlocking member 53 is configured to move the movable link member 64 from the retracted position to the pressing position in interlocking relation to the movement of the front cover 5 from the open position to the closed position. Therefore, simple operation for moving the front cover 5 to the closed position can realize movement of the movable link member 64.

(8) The leaf spring 66 is provided for each photosensitive drum 32. Therefore, the photosensitive drum 32 can be brought into contact with the intermediate transfer belt 22 of the belt unit 15 with a simple construction.

In a conventional art, in order to avoid frictional contact between the photosensitive drum 32 of the process unit 17 and the intermediate transfer belt 22, the process unit 17 is positioned below and spaced apart from the belt unit 15 when moving, and the process unit 17 is entirely lifted upward to bring the photosensitive drum 32 into contact with the intermediate transfer belt 22 after the process unit 17 has reached the internal position.

However, in this case, for entirely lifting the process unit 17 upward against gravity, application of a greater force is required. Hence, operability is degraded.

In comparison with the conventional art, in the above-described embodiment, only the process cartridge 31 is lifted upward to bring the photosensitive drum 32 into contact with the intermediate transfer belt 22 after the process unit 17 has been horizontally moved. Therefore, in the configuration such that the process unit 17 is positioned below the belt unit 15, operability in positioning the photosensitive drums 32 relative to the belt unit 15 can be greatly improved.

Further, in a conventional color printer, there is a defect such that a process cartridge is required to be constantly urged upward, otherwise a photosensitive drum frictionally contacts a belt unit when a process unit is inserted into a main casing. In comparison with this conventional art, in the above-described embodiment, the process cartridge 31 is provided at a position spaced apart from the belt unit 15 (i.e. below the belt unit 15) by virtue of gravity. Hence, an urging unit for constantly urging the process cartridge 31 upward can be omitted.

8. Second Embodiment

Figure 9:
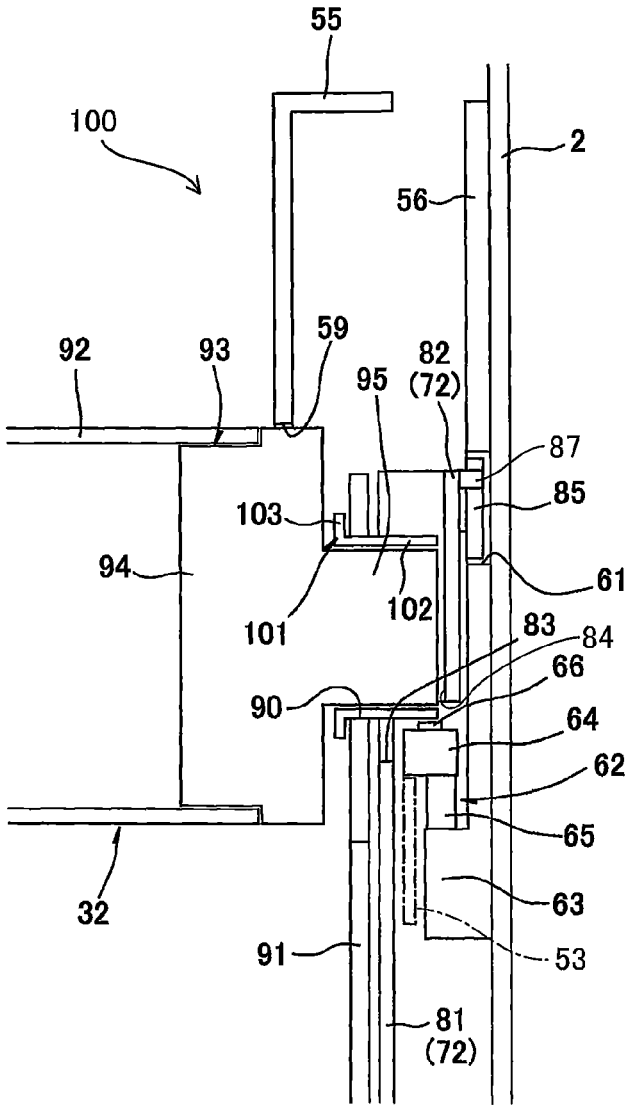
FIG. 9 is a cross-sectional view of an essential portion of a pressing mechanism according to a second embodiment of the present invention.

A color printer 100 according to a second embodiment of the present invention will then be described with reference to FIG. 9. In the following description, only parts differing from those of the first embodiment will be described.

In the first embodiment, the flange portion 93 of the photosensitive drum 32 is rotatably supported to the cartridge frame 91 of the process cartridge 31. In the second embodiment, on the other hand, a shaft supporting member 101 is interposed between the flange portion 93 and a side wall of the cartridge frame 91.

The shaft supporting member 101 has a cylindrical insertion portion 102 and an annular flange portion 103. The flange portion 103 is integral with the insertion portion 102 and extends radially outwardly from one end of the insertion portion 102.

The insertion portion 102 has an inner diameter substantially equal to an outer diameter of the shaft portion 95 of the flange portion 93. Further, the insertion portion 102 has an outer diameter substantially equal to an inner diameter of the shaft supporting hole 90 formed in the cartridge frame 91.

The flange portion 103 has an outer diameter greater than the inner diameter of the shaft supporting hole 90.

The shaft portion 95 of the flange portion 93 is fitted into the insertion portion 102 and rotatable relative to the insertion portion 102. The flange portion 103 is positioned at a base end side of the shaft portion 95 (at an insertion portion 94 side). The insertion portion 102 of the shaft supporting member 101 is fitted into the shaft supporting hole 90 formed in the cartridge frame 91. The insertion portion 102 is not rotatable relative to the shaft supporting hole 90.

The insertion portion 102 of the bearing member 101 has an outer circumferential surface a portion of which is exposed downward to an outside through the opening 84 formed between the first side plate 81 and the second side plate 82 when the process cartridge 31 is mounted on the process unit 17 (FIG. 5). The portion of the insertion portion 102 exposed through the opening 84 is in abutment with the corresponding leaf spring 66 from below when the process unit 17 is in the internal position.

When the movable link member 64 is moved upward in conjunction with the movement of the front cover 5 from the open position to the closed position, the insertion portion 102 is elastically pushed upward by the corresponding leaf spring 66. Each process cartridge 31 in its entirety is thus moved upward via the shaft supporting members 101.

Subsequently, when the front cover 5 is in the closed position, the flange portion 93 is entered into the corresponding positioning recess 59 and the photosensitive drum 32 is in abutment with the intermediate transfer belt 22 of the process unit 17 from below. The positioning of the photosensitive drum 32 relative to the belt unit 15 is thus achieved.

With the above-described construction of the second embodiment, the technical advantages the same as those of the first embodiment can be attainable.

Further, the shaft supporting member 101 is supported to the cartridge frame 91 so as not to rotate relative to the same, and the leaf spring 66 presses the shaft supporting member 101. Thus, when forming an image, frictional contact between the leaf spring 66 and the shaft supporting member 101 can be avoided while the photosensitive drum 32 rotates.

3. Third Embodiment

Figure 10:
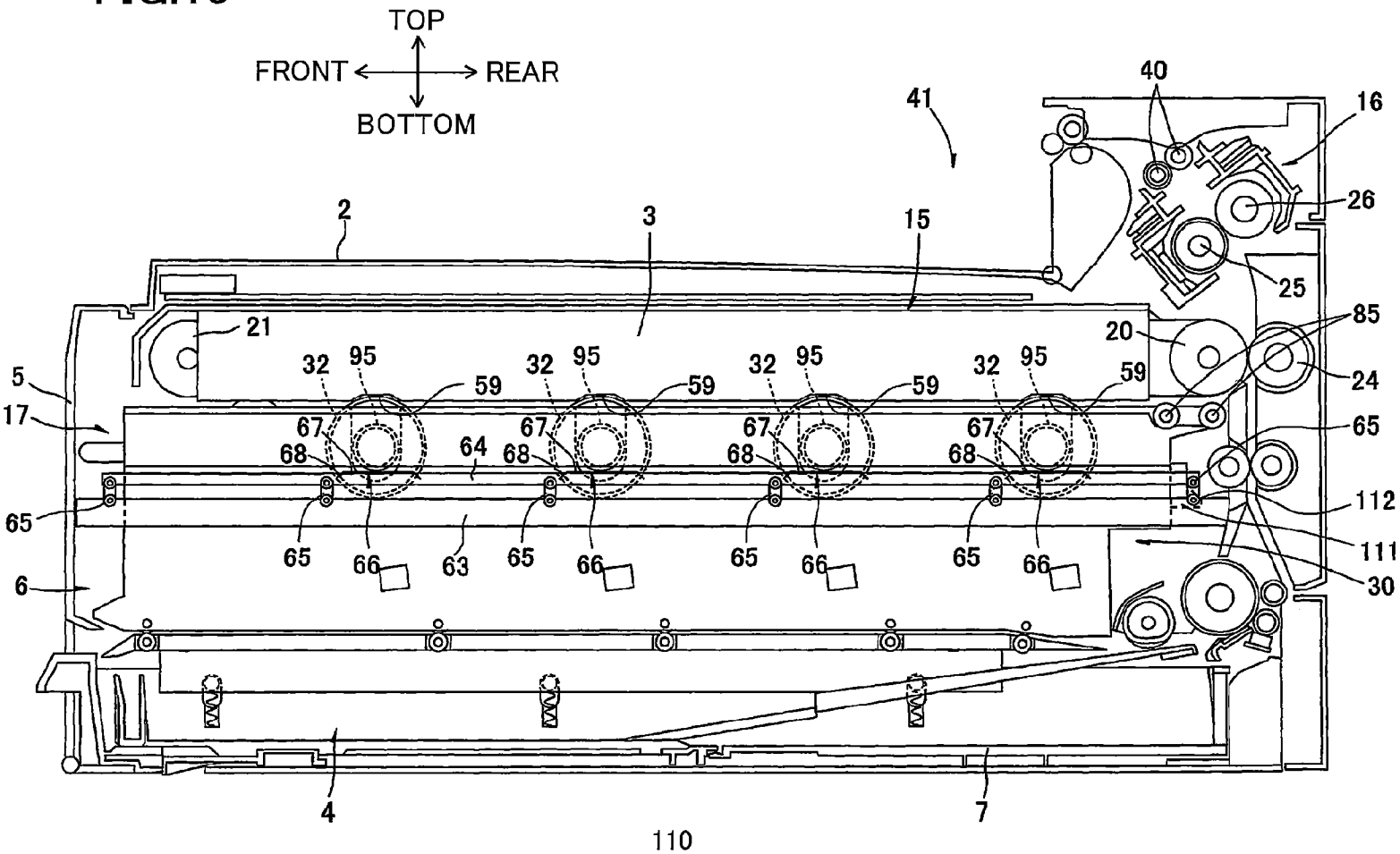
FIG. 10 is a cross-sectional side view of a color printer according to a third embodiment of the present invention.

A color printer 110 according to a third embodiment of the present invention will then be described with reference to FIG. 10. In the following description, only parts differing from those of the first embodiment will be described.

In the third embodiment, instead of the pair of interlocking members 53 provided at the inner side surface of the front cover 5, a pair of interlocking members 111 is provided at rear end portion of side plates 72 of the process unit 17.

Each interlocking member 111 has a shape identical to that of the interlocking member 53 of the first embodiment. That is, the interlocking member 111 is generally rectangular shaped and has a rear end surface including a flat surface (shown without a reference numeral) and a sloped surface 112. The sloped surface 112 extends from a lower end portion of the flat surface diagonally downward and rearward.

In the third embodiment, a boss (not shown) is provided at the rear end portion of each movable link member 64, unlike the boss of the first embodiment that is provided at the front end portion of each movable link member 64.

The boss is moved along the sloped surface 112 upward and rearward in interlocking relation to the movement of the process unit 17 to the internal position. The movable link member 64 is moved upward in conjunction with the movement of the boss, and the photosensitive drum 32 is elastically pressed upward by the leaf spring 66.

When the process unit 17 is in the internal position, the photosensitive drum 32 elastically contacts the intermediate transfer belt 22 of the process unit 17 from below. The photosensitive drum 32 is thus positioned relative to the belt unit 15.

With the above-described construction of the third embodiment, the technical advantages the same as those of the first embodiment can be attainable.

Further, according to the construction of the third embodiment, the movable link member 64 can be moved to the pressing position simply by mounting the process unit 17 in the main casing 2, regardless of the movement of the front cover 5.

While the invention has been described in detail with reference to the embodiments thereof, it would be apparent to those skilled in the art that various changes and modifications may be made therein without departing from the spirit of the invention.

What is claimed is:

1. An image forming apparatus comprising:

a frame;

a first photosensitive drum having a rotational axis extending in an axial direction, the first photosensitive drum being configured to rotate about the rotational axis, the first photosensitive drum including a drum body and a first flange portion, the drum body having one end portion in the axial direction, the first flange portion being provided on the one end portion of the drum body, and the first flange portion having a first contacted portion and a first pressed portion;

an endless belt disposed above the first photosensitive drum; and a first pressing member configured to press the first pressed portion upward to permit the first photosensitive drum to be in contact with the endless belt, wherein the frame has a first positioning portion disposed above the first pressing member and above the first photosensitive drum, the first positioning portion being configured to be in contact with the first contacted portion and to position the first photosensitive drum when the first pressing member presses the first pressed portion, and wherein the first pressed portion is disposed farther from the drum body in the axial direction than the first contacted portion.

2. The image forming apparatus according to claim 1, wherein the first photosensitive drum further includes a second flange portion, the drum body further having another end portion opposite to the one end portion in the axial direction, the second flange portion being provided on the other end portion of the drum body, the second flange portion having a second contacted portion and a second pressed portion, wherein the second pressed portion is disposed farther from the drum body in the axial direction than the second contacted portion, wherein the image forming apparatus further comprises a second pressing member configured to press the second pressed portion upward to permit the first photosensitive drum to be in contact with the endless belt, and wherein the frame further has a second positioning portion configured to be in contact with the second contacted portion and to position the first photosensitive drum when the second pressing member presses the second pressed portion.

3. The image forming apparatus according to claim 2, further comprising:

a link member movable between a pressing position and a retracted position, the link member including a first link member and a second link member, the first pressing member being connected to the first link member, the second pressing member being connected to the second link member; and a linkage mechanism connected to the link member and configured to move the link member between the pressing position where the first pressing member presses the first pressed portion and the second pressing member presses the second pressed portion, and the retracted position where the first pressing members releases pressing force to the first pressed portion and the second pressing member releases pressing force to the second pressed portions.

4. The image forming apparatus as claimed in claim 3, wherein the linkage mechanism comprises:

a base portion provided in and fixed to the frame and positioned below and in confrontation with the link member; and a plurality of joint members connecting the base portion to the link member and configured to move the link member toward and away from the base portion.

5. The image forming apparatus as claimed in claim 3, wherein the frame has an opening through which an interior and exterior of the frame communicate with each other; and the image forming apparatus further comprising:

an opening/closing member pivotally movable between an open position opening the opening and a closed position closing the opening; and an interlocking member configured to move the link member from the retracted position to the pressing position in interlocking relation to movement of the opening/closing member from the open position to the closed position.

6. The image forming apparatus according to claim 2, wherein the first pressing member is a leaf spring and the second pressing member is a leaf spring.

7. The image forming apparatus according to claim 2, wherein the second positioning portion is disposed upstream of the endless belt in a direction that is parallel to the axial direction and directed from the second pressed portion to the drum body.

8. The image forming apparatus according to claim 2, wherein the second positioning portion has a U-shaped notch opening downward and depressed upward from a lower edge of the frame.

9. The image forming apparatus according to claim 2, further comprising:

a second photosensitive drum having the first contacted portion and the first pressed portion, the second photosensitive drum having an axis parallel to the rotational axis of the first photosensitive drum, the second photosensitive drum being configured to rotate about the axis; and a retaining unit configured to retain the first photosensitive drum and the second photosensitive drum that are arranged in a predetermined direction.

10. The image forming apparatus according to claim 9, wherein the retaining unit is movable between an internal position within the frame and an external position outside of the frame, each of the first photosensitive drum and the second photosensitive drum being detachable from the retaining unit when the retaining unit is in the external position.

11. The image forming apparatus according to claim 9, further comprising:

a third pressing member configured to press the first pressed portion of the second photosensitive drum upward to permit the second photosensitive drum to be in contact with the endless belt; and a fourth pressing member configured to press the second pressed portion of the second photosensitive drum upward to permit the second photosensitive drum to be in contact with the endless belt.

12. The image forming apparatus according to claim 1, wherein the first positioning portion is disposed upstream of the endless belt in a direction that is parallel to the axial direction and directed from the first pressed portion to the drum body.

13. The image forming apparatus according to claim 1, wherein the first positioning portion has a U-shaped notch opening downward and depressed upward from a lower edge of the frame.

* * * * *